US005747207A

United States Patent [19]

Mashimo

[11] Patent Number: 5,747,207

[45] Date of Patent: May 5, 1998

[54] ELECTROPHOTOGRAPHIC APPARATUS WITH CHARGE INJECTION LAYER ON PHOTOSENSITIVE MEMBER

[75] Inventor: Seiji Mashimo, Tokyo, Japan

[73] Assignee: Canon Kabushiki Kaisha, Tokyo, Japan

[21] Appl. No.: 708,301

[22] Filed: Sep. 4, 1996

[30] Foreign Application Priority Data

Sep. 6, 1995 [JP] Japan ..... 7-229430

[51] Int. Cl.[6] ..... G03G 5/147

[52] U.S. Cl. ..... 430/66; 399/168

[58] Field of Search ..... 430/56, 57, 66; 399/168

[56] References Cited

U.S. PATENT DOCUMENTS 5,258,250 11/1993 Shirai et al. ..... 430/66

5,262,262 11/1993 Yagi et al. ..... 430/66

5,447,812 9/1995 Fukuda et al. ..... 430/66

FOREIGN PATENT DOCUMENTS 63-149669 6/1988 Japan .

6-3921 1/1994 Japan .

*Primary Examiner*—John Goodrow

*Attorney, Agent, or Firm*—Fitzpatrick, Cella, Harper & Scinto

[57] ABSTRACT

An electrophotographic apparatus includes a photosensitive member for bearing an image, the photosensitive member having a photosensitive layer and a charge injection surface layer outside of the photosensitive layer; a charging member, contactable to the photosensitive member, for electrically charging the photosensitive member; and wherein the charge injection layer has a volume resistivity which is larger at a surface than inside thereof.

6 Claims, 1 Drawing Sheet

ELECTROPHOTOGRAPHIC APPARATUS WITH CHARGE INJECTION LAYER ON PHOTOSENSITIVE MEMBER

FIELD OF THE INVENTION AND RELATED ART

The present invention relates to an electrophotographic apparatus such as a copying machine, a laser beam printer, and the like, in particular, an electrophotographic apparatus comprising a charging member which charges an object to be charged, by coming in contact with the object.

In the past, a corona type charging device was used as the charging apparatus for an electrophotographic image forming apparatus. However, in recent years, a contact type charging apparatus has come to be put into practical use in place of the corona type charging device. The contact type charging apparatus is used to reduce ozone production and also to consume less electricity. In particular, a contact type charging apparatus based on a roller type charging system which uses an electrically conductive roller as the contact type charge member is preferable in terms of charge stability, and has come to be widely used.

In the contact type charging apparatus based on the roller type charging system, an object to be charged (photosensitive member) is charged by placing an electrically conductive elastic roller in contact with the photosensitive member, with a predetermined contact pressure, and applying voltage to the elastic roller.

Also in the case of the contact type charging apparatus based on the roller type charging system, the object to be charged is charged through electrical discharge from the charging member to the object, wherein the object begins to be charged as the applied voltage increases above a threshold voltage (charge start voltage Vth). For example, when a charge roller is placed in contact with a photosensitive member comprising a 25 μm thick OPC, the surface potential of the photosensitive member begins to increase as the applied voltage reaches about 640 V, and above 640 V, the surface potential of the photosensitive member linearly increases at an inclination of one to one relative to the applied voltage.

In other words, in order to give the photosensitive member a surface potential of Vd which is necessary for image formation, a DC voltage of Vd+Vth must be applied to the charge roller. This system of applying only DC voltage to the contact type charging member to charge the photosensitive member is called the DC charging system.

However, in the case of the DC charging system, the resistance value of the contact type charging member changes in response to environmental changes. Also, the thickness of the photosensitive member changes due to shaving, which causes the charge start voltage Vth to change. Therefore, it is difficult to give the photosensitive member a surface potential of a predetermined value.

Japanese Laid-Open Patent Application No. 149,669/1988 discloses a system for uniformly charging the photosensitive member. This charging system is an AC charging system, and according to this system, a charge voltage composed of a DC voltage equivalent to the desired surface voltage Vd for the photosensitive drum, and an AC voltage having a peak-to-peak voltage of no less than 2×Vth, is applied to the contact type charging member. The application of a charge voltage such as the above is effective for leveling (averaging); the potential of the object to be charged converges to the surface potential Vd which is the middle of the peak-to-peak voltage of the AC voltage, and therefore, is not affected by external disturbance such as environmental change.

However, even in the case of the contact type charging apparatus such as the above, the charging mechanism is based on the electrical discharge from the charging member to the photosensitive member.

Therefore, the voltage necessary to charge the photosensitive member must have a value larger than the value of the surface potential of the photosensitive member. As a result, ozone is generated, although the amount is small. Further, when the AC charging is employed to accomplish charge uniformity, a larger amount of ozone is generated. In addition, the charging member and the photosensitive member are vibrated by the electric field of the AC voltage, causing noises (hereinafter, AC noise). Further, the surface deterioration of the photosensitive member due to the electrical discharge becomes prevalent, which creates a new problem.

Accordingly, a new charging system has been devised, in which electrical charge is directly injected into the photosensitive member. For example, Japanese Laid Open Patent Application No. 3,921/1994 or the like discloses a charging apparatus based on the direct injection charging system. According to this system, the photosensitive member is provided with a surface of an electric charge injection layer 10, and electrical charge is injected into the float electrode of the photosensitive member by applying voltage to an electrically conductive member of the contact type, such as a charge roller, a charge brush, or a magnetic charge brush, which is placed in contact with the photosensitive member. More specifically, the electric charge injection layer 10 is composed of a mixture of acrylic resin, and $SnO_2$ particles dispersed in the acrylic resin, wherein the particles are doped with antimony for electrical conductivity.

It is coated on the photosensitive member base.

Since the direct injection charging system does not depend on the electric discharge phenomenon, it does not generate ozone, and requires only a DC voltage equivalent to a predetermined surface potential to be given to the photosensitive member. In addition, since the application of AC voltage is not necessary, there is no charging noise. Thus, the direct injection charging system is superior in terms of low voltage and low ozone generation, compared with the roller type charging system.

However, in the case of an image forming apparatus comprising a direct injection charging system of a prior type, the electric charge injection layer 10 is formed of uniform resistive film, and electric charge is injected only through the contact area between the photosensitive member and the charging member. Therefore, in a low humidity environment in which the resistance of the electric charge injection layer 10 of the photosensitive member increases, electric charge is prevented from being sufficiently injected through the charge nip, which is liable to result in poor charge. Further, in a high humidity environment, in which the resistance of the electric charge injection layer 10 decreases, electric charge is not retained in the direction perpendicular to the surface, which is liable to result in an image of a flowing appearance.

SUMMARY OF THE INVENTION

The present invention was made to solve the above problems, and its primary object is to provide an electrophotographic apparatus capable of displaying satisfactory charging performance even in a low humidity environment, and also preventing the occurrence of the image flowing even in a high humidity environment.

Another object of the present invention is to provide an electrophotographic apparatus which requires lower voltage and generates a smaller amount of ozone, in comparison with the prior apparatus.

Another object of the present invention is to provide an electrophotographic apparatus which does not generate charge noise.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the embodiments of the present invention will be described with reference to the drawings.

Embodiment 1

Figure 1:
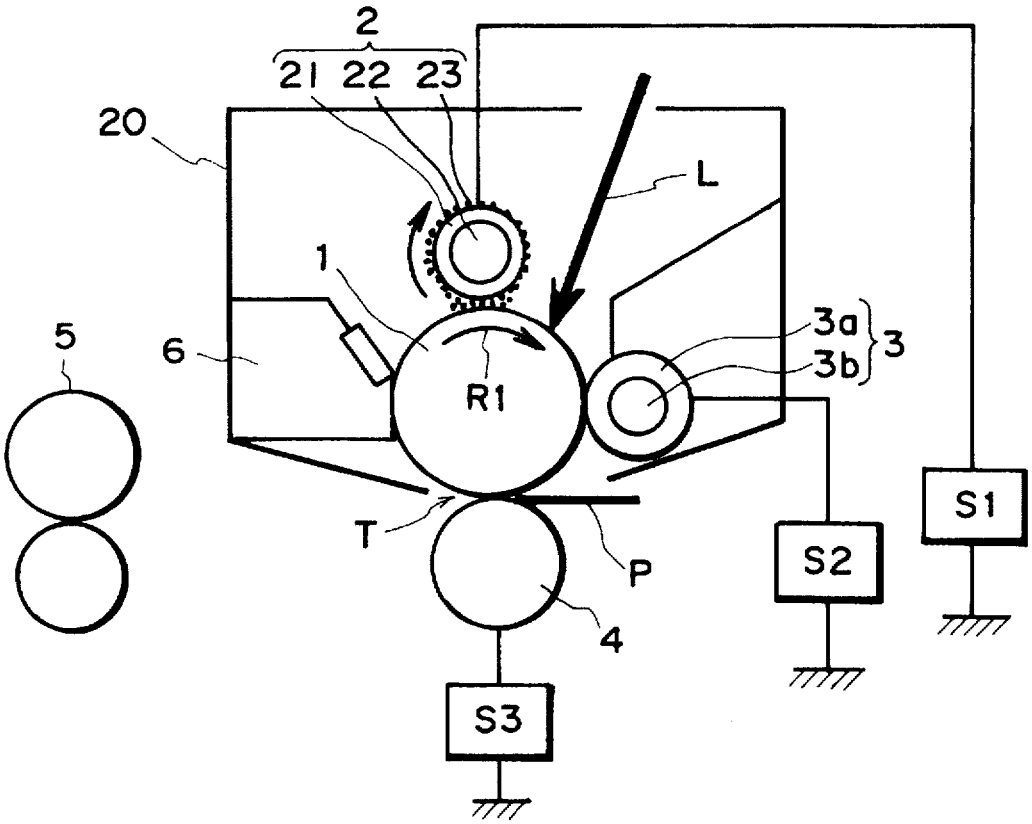
FIG. 1 is a schematic drawing of an image forming apparatus in accordance with the present invention.
Figure 2:
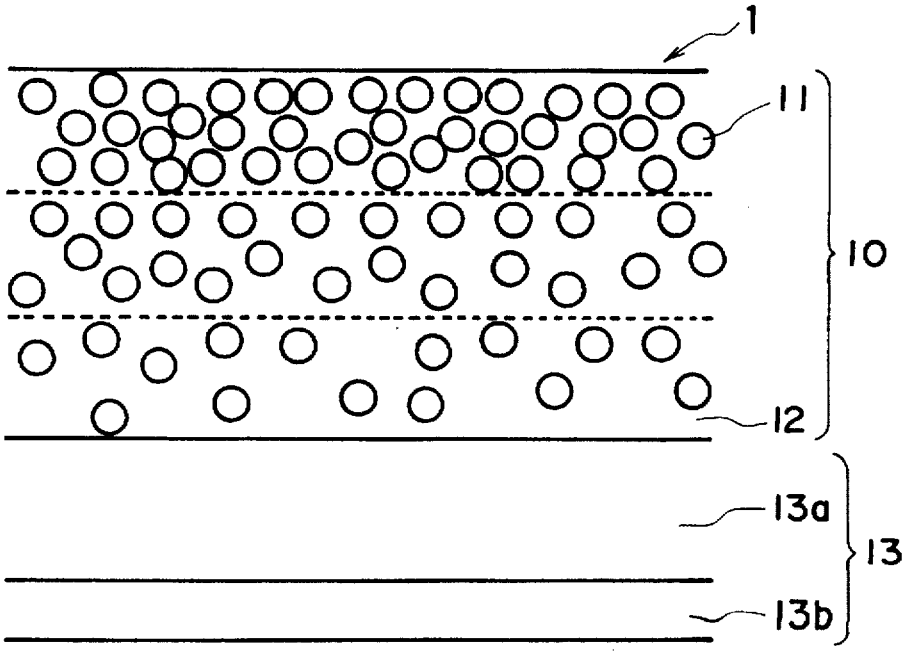
FIG. 2 is a schematic section of the electric charge injection layer 10 of the photosensitive member illustrated in FIG. 1.

FIG. 1 is a schematic drawing of an image forming apparatus in accordance with the present invention. FIG. 2 is a schematic section of the electric charge injection layer 10 of the photosensitive member illustrated in FIG. 1.

First, a description will be given as to a laser beam printer, the image forming apparatus, in this embodiment, which uses an electrophotographic process. In FIG. 1, an electrophotographic photosensitive member 1 (hereinafter, photosensitive member), as an object to be electrically charged, in the form of a rotary drum is rotatively driven in the direction of an arrow mark R1 at a process speed (peripheral velocity) of 100 mm/sec. The photosensitive member 1 is placed in contact with a magnetic brush type charging device 2 as a contact type charging member. The magnetic brush type charging device 2 charges the photosensitive member 1 provided with the charge carrier surface layer, by directly injecting electric charge into the float electrode provided on the photosensitive member 1. The surface of the photosensitive member 1, the surface to be charged, is exposed to a laser beam, which is modulated, in intensity, with sequential electric digital image signals reflecting the image data, and is projected from an unillustrated laser beam scanner comprising a laser diode, a polygon mirror, and the like. As a result, an electrostatic latent image reflecting the image data of a target image is formed on the peripheral surface of the photosensitive member 1. The electrostatic latent image formed on the photosensitive member 1 is developed as a toner image by a reversal development apparatus 3 which uses electrically insulating single component magnetic toner. The reversal development apparatus 3 comprises a magnet roller 3b, and a nonmagnetic development sleeve 3a which is rotatively fitted around the magnet roller 3b, and has a diameter of 16 mm. The distance between the surface of the nonmagnetic development sleeve 3a and the surface of the photosensitive member 1 is set to 300 μm, and the nonmagnetic development sleeve 3a is rotated at the same peripheral velocity as the photosensitive member 1. The nonmagnetic development sleeve 3a is connected to a development bias power source S2, which applies to the sleeve 3a, a development bias composed of a DC voltage of −500 V, and an AC voltage superposed on the DC voltage. The AC voltage has a frequency of 1,800 Hz, and a peak-to-peak voltage of 1,600 V. The nonmagnetic development sleeve 3a is coated with the electrically insulating single nonmagnetic single component toner, and the electrostatic latent image is developed into the toner image through the toner jumping phenomenon which occurs between the nonmagnetic development sleeve 3a and the photosensitive member 1.

On the other hand, a transfer sheet P as a recording medium fed from an unillustrated sheet feeder portion is introduced, with a predetermined timing, into a pressure nip T (transfer portion) formed between the photosensitive member 1 and a transfer roller 4 as transferring means of a contact type placed in contact with the photosensitive member 1 with a predetermined contact pressure. To the transfer roller 4, a predetermined transfer bias is applied from the transfer bias application power source S3. In this embodiment, the transfer roller 4 has a resistance value of $5\times10^8$, and the voltage applied from the transfer bias application power source S3 has a DC voltage of +2,000V.

The transfer sheet P introduced into the transfer portion T is pinched by the nip, and thereby advanced further. While the transfer sheet P is advanced through the transfer portion T, the toner image having been borne on the surface of the photosensitive member 1 is transferred onto the surface of the transfer sheet P with electrostatic force and pressure, sequentially from the leading end to the trailing end.

After the toner image transfer, the transfer sheet P is separated from the surface of the photosensitive member 1, and then, is introduced into a fixing apparatus 5 based on the thermal fixation system or the like, in which the toner image is fixed to the transfer sheet P. Thereafter, the transfer sheet P is discharged as a print from the image forming apparatus.

After the toner image transfer onto the transfer sheet P, a certain amount of contaminant such as residual toner remains on the surface of the photosensitive member 1, and this residual contaminant is removed by a cleaning apparatus 6 so that the photosensitive member 1 is repeatedly used for image formation.

The image forming apparatus in this embodiment employs a processing cartridge comprising four processing devices: the photosensitive member 1, the magnetic brush type charging device 2, the reversal development apparatus 3, and the cleaning apparatus 6, which are housed in a cartridge shell 20 so that they can be installed into, or removed from, the main assembly of the image forming apparatus all at once. However, the application of the present invention is not limited to the example described in this embodiment. Instead, the cartridge has only to comprise the photosensitive member, and at least one among the charging device, the development device, and the cleaning apparatus.

Next, the photosensitive member 1 in this embodiment will be described.

The photosensitive member 1 is a photosensitive member composed of negatively chargeable OPC. It is formed by placing five functional layers, in the order of the first to fifth layers from the bottom, on the peripheral surface of an aluminum base having a diameter of 30 mm.

The first layer is an undercoat layer which is an approximately 20 μm thick electrically conductive layer. It is coated on the aluminum base member to smooth the surface thereof by filling or covering the defects thereon, and also to prevent the occurrence of the moire resulting from the laser beam reflection.

The second layer is an approximately 1 μm thick intermediate resistance layer which prevents the injection of positive electric charge. It plays a role in preventing the positive electric charge injected from the aluminum drum base from cancelling the negative electric charge accumulated on the surface of the photosensitive member 1. The resistance of the second layer is adjusted to approximately $10^6$ with the use of AMILAN resin and methoxymethyl nylon.

The third layer is an approximately 0.3 μm thick charge carrier layer 13b formed of a mixture of resin, and diazo pigment dispersed therein, and generates a positive-negative pair of electric charges when exposed to a laser beam.

The fourth layer is a charge transfer layer 13a (hereinafter, CT layer), which prevents the negative charge given to the surface of the photosensitive member 1 from transferring, and allows only the positive charge generated in the charge carrier layer, to transfer to the surface of the photosensitive member 1. It is a layer of P-type semiconductor composed by dispersing hydrazone in polycarbonate resin. The photosensitive layer 13 is constituted of the charge carrier layer 13b and the charge transfer layer 13a.

The fifth layer is an electric charge injection layer 10 10, which is formed of material composed by dispersing microscopic particles in photo-hardening acrylic resin. More specifically, $SnO_2$ particles doped with antimony to reduce resistance, having an approximate diameter of 0.03 μm, are dispersed in the resin. Further, in order to reduce the friction between the fifth layer and the charge brush (magnetic brush), Teflon particles are dispersed in the binder.

Referring to FIG. 2, the charge injection layer 10 in this embodiment comprises three layers, in which the tin oxide 11 as the electrically conductive particle in the binder 12 is dispersed by different amounts. More specifically, three mixtures, containing $SnO_2$ by 50 wt. %, 70 wt. %, and 90 wt. %, are coated in the form of 1.5 μm thick film, on the CT layer, in this order from the bottom, by a beam coating method, so that the resistance value on the surface side becomes smaller than those on the interior sides.

The ratio by which the tin oxide particles are dispersed is defined by the following formula:

Dispersion ratio [wt.%]={Weight of electrically conductive filler/(Weight of electrically conductive filler+Weight of resin binder}×100

The volumetric resistance value for each layer is as follows:

TABLE 1

| Dispersion (wt. %) | Volume resistivity (ohm.cm) |
|---|---|
| 50 | $1 \times 10^{14}$ |
| 70 | $5 \times 10^{12}$ |
| 90 | $2 \times 10^{10}$ |

The volumetric resistance values given in the above table were obtained in the following manner. First, two metallic electrodes were disposed 200 μm apart, and the mixture for the charge injection layer 10 was injected between the two electrodes, forming a film of the mixture. Then, the volumetric value of this film was measured by applying 100 V between the two electrodes.

The resistance value of the outermost surface of the charge injection layer 10 is preferable to be no more than $1\times10^{13}\Omega\cdot$cm, more preferably, no more than $1\times10^{11}$, so that the electric charge from the contact type charging member 2 can be easily injected. The resistance values of the interior sub-layers of the charge injection layer 10 are preferable to be no more than $1\times10^{15}$ so that the residual potential from image formation can be suppressed.

Next, the layer in which $SnO^2$ particles were dispersed by 50% will be described in more detail. The mixture comprises 60 parts of photo-hardening acrylic monomer, 60 parts of microscopic tin oxide particles, 50 parts of microscopic particles of polytetrafluoroethylene, 20 parts of 2-methyloxanton as photo-initiation agent, and 400 parts of methanol. They are process in a sand mill for 48 hours to accomplish preferable dispersion.

This preparation was applied to the CT layer by the beam coating method, forming film. After drying, the film is hardened for 20 seconds with the light from a high pressure mercury lamp, having an intensity of 8 mW/cm$^2$. The obtained film had a thickness of 1.5 μm.

The other two sub-layers of film, in which different amounts of tin oxide particles were dispersed, were formed sequentially using the same method, completing the charge injection layer 10.

In this embodiment, the beam coating method was employed as the coating method for the charge injection layer 10. However, other methods such as spray coating or dip coating may be employed. In order to employ the dip coating method, proper solvent must be selected.

As for material usable as the electrically conductive particles in accordance with the present invention, it is possible to use, in addition to the tin oxide described above, oxides of metal such as copper (Cu), aluminum (Al), or nickel (Ni), as well as zinc oxide, titanium oxide, antimony oxide, indium oxide, bismuth oxide, and zirconium doped with antimony, in the form of microscopic particle. These metallic oxides may be employed alone or as a mixture of two or more. When two or more materials are employed, they may be in the state of solid solution or in the fused state.

As for the average diameter of the electrically conductive particles, it is preferable to be no more than 0.3 μm, more preferably, no more than 0.1 μm, so that sensitivity of the particle does not decrease.

In addition to the acrylic resin used in this embodiment, the following may be used as the resin for the charge injection layer 10: polycarbonate resin, polyester resin, polyurethane resin, epoxy resin, silicone resin, alkyd resin, polystyrene resin, polypropylene resin, cellulose resin, polyvinylchloride resin, melamine resin, vinylchloride-vinylacetate copolymer, and the like. They may be employed alone or in combination of two or more.

As for the method for dispersing the electrically conductive material, a ball mill, a roll mill, a homogenizer, a paint shaker, or ultrasonic waves, may be used in place of the sand mill.

Further, the charge injection layer 10 may be formed of ion conductive resin.

Next, the magnetic brush type charging device 2 of this embodiment will be described.

The magnetic brush type charging device 2 comprises an electrically conductive, nonmagnetic, rotary sleeve 21 having a diameter of 16 mm, a magnetic roller 22 enclosed within the electrically conductive sleeve 21, and a carrier 23 (electrically conductive magnetic particle) held on the surface of the electrically conductive sleeve 21 by magnetic force.

The magnetic flux density at the surface of the conductive sleeve 21 was 0.1 T (tesla). It is preferred to be no less than 0.03 T, considering that the carrier 23 is held by magnetic force.

The carrier 23 in this embodiment was a medium resistance ferrite carrier which had an average particle diameter of 30 μm, a maximum magnetization of 60 Am2/kg, and a density of 2.2 g/cm2. The gap between the surface of the conductive sleeve 21 and the surface of the photosensitive member 1, in the charging nip portion, was maintained at 500 μm. The charging width in the longitudinal direction was 200 mm, and when the amount of the carrier on the conductive sleeve 21 was set at 12 g, the width of the charging nip inclusive of the carrier reservoir was approximately 5 mm. The carrier resistance value within this charge nip width was $5\times10^6\Omega$ when a DC voltage of 100 V was applied.

The peripheral velocity ratio between the magnetic brush type charging device 2 and the photosensitive member 1 is defined by the following formula:

Peripheral velocity ratio={(Magnetic brush peripheral velocity−Photosensitive member peripheral velocity)/Photosensitive member peripheral velocity}×100

The peripheral velocity of the magnetic brush 2 rotating in the direction opposite to the rotational direction of the photosensitive member 1 becomes negative. In consideration of the contact chance between the magnetic brush 2 and the photosensitive member 1, the peripheral velocity ratio is preferred to have an absolute value of no less than 100%. A value of −100% means that the magnetic brush is stationary. In such a case, charge failure occurs at the spots where the magnetic brush 2 does not make proper contact with the surface of the photosensitive member 1, and as a result, the surface condition of the portion of the stationary magnetic brush, in the contact nip, is reflected in the formed image. As for the peripheral velocity ratio when both are rotating in the same direction, an attempt to obtain the same peripheral velocity ratio as that for the counter rotation makes the revolution of the magnetic brush rather high, creating ill effects such as the scattering of the carrier 23. The peripheral velocity ratio in this embodiment was −200%.

Further, in this embodiment, the magnetic brush type charging device 2 was employed as the charging device, but any charging device, for example, a fur brush type charging device, which is capable of making preferable contact with the photosensitive member 1 may be employed.

As a DC charge bias of −700 V is applied to the magnetic brush 2 from the charge bias application power source S1, the peripheral surface of the photosensitive member 1 is uniformly charged to substantially −700 V.

Since the resistance value is smaller in the outermost portion of the charge injection layer 10, charge can be sufficiently injected within the charge nip portion even in such an environment as a low humidity environment in which charge injection is difficult. The injected charge is attracted close to the interface between the charge injection layer 10 and the CT layer by the opposing charge. This sub-layer portion of the charge injection layer 10 close to the above interface has high enough resistance to prevent the latent image charge from horizontally shifting even in a high humidity environment. Therefore, the image flow does not occur.

As for the means for varying the volumetric resistance of the charge injection layer 10, between the outermost side and the innermost side in the thickness direction of the charge injection layer 10, any means is acceptable as long as it does not prevent the injected charge from moving close to the aforementioned interface between the charge injection layer 10 and the CT layer. The resistance may be changed in steps, or slopingly. Further, the charge injection layer 10 does not need to comprise three sub-layers as it does in this embodiment, as long as the aforementioned conditions are met. It may be structured in two sub-layers, or four or more sub-layers.

As described above, with the provision of the charge injection layer 10, it is possible to obtain the photosensitive member 1 which can be sufficiently charged by charge injection even in a low humidity environment, and can prevent the occurrence of the image flow even in a high humidity environment. As a result, it is possible to reliably output a high quality image in all environments.

As is evident from the above description, the photosensitive member 1 in this embodiment is characterized in that the amount of the electrically conductive particles 11 dispersed in the charge injection layer 10 is varied in the thickness direction of the charge injection layer 10 to differentiate the volumetric resistance between the outermost side and the innermost side of the charge injection layer 10 in such a manner that the volumetric resistance on the outermost side becomes lower.

Embodiment 2

Next, the second embodiment will be described.

This embodiment is characterized in that the resistance value itself of the electrically conductive particle dispersed in the charge injection layer 10 is varied in the thickness direction of the charge injection layer 10; the resistance value of the electrically conductive particle dispersed on the outermost side of the charge injection layer 10 is smaller than that on the innermost side.

Basically, the charge injection layer 10 in this embodiment is formed in the same manner as that in the first embodiment, except for a minor variation. That is, it is formed by dispersing in the photo-hardening acrylic resin, the $SnO_2$ particles which have been doped with antimony for resistance reduction, and has a particle diameter of approximately 0.03 μm. In this case, the resistance value of the $SnO_2$ particle can be adjusted by varying the amount of surface treatment.

In this embodiment, the charge injection layer 10 was constituted of three sub-layers, A, B and C sub-layers, each sub-layer containing $SnO_2$ particles different in the amount of surface treatment from those in the other sub-layers. The resistance value of these sub-layers were as follows:

TABLE 2

| Layers | Resistance (ohm.cm) |
|---|---|
| Layer A | $3\times10^{14}$ |
| Layer B | $8\times10^{11}$ |
| Layer C | $1\times10^{9}$ |

The charge injection layer 10 was formed by spray coating three sub-layers to a film thickness of 1.5 μm on the CT layer in the order of A, B and C.

When the thus obtained photosensitive member 1 was placed in the image forming apparatus of the first embodiment, and used to output images, it could be uniformly charged in all environments, producing preferable images.

Incidentally, the amounts of the $SnO_2$ dispersed in the A, B and C sub-layers do not need to be the same, as long as the sub-layer order, in terms of resistance, is kept the same.

As is evident from the above description, according to the present invention, the volumetric resistance of the charge injection layer 10 provided on the photo-conductive layer is varied in the thickness direction of the charge injection layer 10 so that the resistance value on the outermost side becomes smaller than that on the innermost side. As a result, the photosensitive member can be sufficiently charged by charge injection even in a low humidity environment, and also, the occurrence of the image flow can be prevented even in a high humidity environment.

Therefore, it is possible to improve the chargeability of the photosensitive member surface so that high quality images can be reliably outputted in any environment.

While the invention has been described with reference to the structures disclosed herein, it is not confined to the details set forth, and this application is intended to cover such modifications or changes as may come within the purposes of the improvements or the scope of the following claims.

What is claimed is:

1. An electrophotographic apparatus comprising:

a photosensitive member for bearing an image, said photosensitive member having a photosensitive layer and a charge injection surface layer outside of said photosensitive layer, said charge injection layer comprises a binder and electroconductive particles dispersed in the binder;

a charging member, contactable to said charge injection layer, for electrically charging said photosensitive member; and wherein said charge injection layer has a volume resistivity which is smaller at a surface than inside thereof.

2. An apparatus according to claim 1, wherein an amount of the particles is larger at the surface thereof than inside thereof.

3. An apparatus according to claim 2, wherein said charge injection layer has a first layer at the surface thereof, a second layer inside thereof, and an amount of the particles is larger in the first layer than in the second layer.

4. An apparatus according to claim 1, wherein a resistance of the particles is smaller at the surface thereof than inside thereof.

5. An apparatus according to claim 4, wherein said charge injection layer has a first layer at the surface thereof, a second layer inside thereof, and a resistance of the particles is smaller in the first layer than in the second layer.

6. An apparatus according to claim 1, wherein a voltage resistivity of the surface of said charge injection layer is not more than $10^{13}$ ohm.cm.

* * * * *